US010471714B2

(12) United States Patent
Chen et al.

(10) Patent No.: US 10,471,714 B2
(45) Date of Patent: Nov. 12, 2019

(54) PRINTHEAD

(71) Applicant: Hewlett-Packard Development Company, L.P., Houston, TX (US)

(72) Inventors: Chien-Hua Chen, Corvallis, OR (US); Michael W. Cumbie, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/748,914

(22) PCT Filed: Oct. 12, 2015

(86) PCT No.: PCT/US2015/055109

§ 371 (c)(1),
(2) Date: Jan. 30, 2018

(87) PCT Pub. No.: WO2017/065728

PCT Pub. Date: Apr. 20, 2017

(65) Prior Publication Data

US 2019/0001676 A1 Jan. 3, 2019

(51) Int. Cl.

| | |
|---|---|
| ***B41J 2/14*** | (2006.01) |
| ***B41J 2/155*** | (2006.01) |
| ***B41J 2/16*** | (2006.01) |

(52) U.S. Cl.

CPC ..... *B41J 2/14072* (2013.01); *B41J 2/155* (2013.01); *B41J 2/1603* (2013.01); *B41J 2/1631* (2013.01); *B41J 2/1632* (2013.01); *B41J 2/1635* (2013.01); *B41J 2/1637* (2013.01); *B41J 2202/20* (2013.01)

(58) Field of Classification Search

CPC .... B41J 2/14072; B41J 2/1637; B41J 2/1635; B41J 2/1631; B41J 2/1603; B41J 2/155; B41J 2/1632; B41J 2202/20

See application file for complete search history.

(56) References Cited

U.S. PATENT DOCUMENTS

| | | | |
|---|---|---|---|
| 7,032,995 | B2 | 4/2006 | Silverbrook et al. |
| 7,347,533 | B2 | 3/2008 | Elrod et al. |
| 7,370,943 | B2 | 5/2008 | Imai et al. |
| 7,875,504 | B2 | 1/2011 | Silverbrook et al. |
| 8,251,497 | B2 | 8/2012 | Petruchik |

(Continued)

FOREIGN PATENT DOCUMENTS

| | | |
|---|---|---|
| JP | H06110256 | 4/1994 |
| JP | 06316065 | 11/1994 |

(Continued)

OTHER PUBLICATIONS

IP.com search (Year: 2018).*

(Continued)

*Primary Examiner* — Lisa Solomon
(74) *Attorney, Agent, or Firm* — HP Inc. Patent Department

(57) ABSTRACT

A printhead includes a number of inkjet slivers molded into a moldable substrate. The overmolded inkjet slivers form at least one die. The printhead also includes a number of wire bonds electrically coupling the inkjet slivers to a side connector. The side connector electrically couples the inkjet slivers to a controller of a printing device.

20 Claims, 13 Drawing Sheets

(56) References Cited

U.S. PATENT DOCUMENTS

| | | | |
|---|---|---|---|
| 8,496,317 | B2 | 7/2013 | Ciminelli et al. |
| 2003/0134940 | A1 | 7/2003 | Morrison et al. |
| 2007/0197734 | A1 | 8/2007 | Matsuoka et al. |
| 2009/0079793 | A1 | 3/2009 | Chung-Long-Shan et al. |
| 2012/0154486 | A1 | 6/2012 | Anderson et al. |
| 2012/0212540 | A1 | 8/2012 | Dietl |
| 2013/0115552 | A1 | 5/2013 | Yoshie et al. |

FOREIGN PATENT DOCUMENTS

| | | |
|---|---|---|
| JP | 2004228142 | 8/2004 |
| JP | 2005005363 | 1/2005 |
| JP | 2009255447 | 11/2009 |
| JP | 2011027845 | 2/2011 |
| WO | WO-2010106874 | 9/2010 |
| WO | 2012012090 | 1/2012 |
| WO | 2014133600 | 9/2014 |
| WO | WO-2014133600 | 9/2014 |
| WO | 2015080730 | 6/2015 |
| WO | WO-2015080730 | 6/2015 |

OTHER PUBLICATIONS

International Searching Authority, "Search Report," issued in connection with PCT Patent Application No. PCT/US2015/055109, dated Jun. 29, 2016, 5 pages.

International Searching Authority, "Written Opinion," issued in connection with PCT Patent Application No. PCT/US2015/055109, dated Jun. 29, 2016, 8 pages.

Watanabe et al., "High Quality, High Speed, Next-Generation Inkjet Technology with Scalability from Serial Printheads to Lineheads," Published on Jan. 1, 2014, retrieved from the internet [http://www.ingentaconnect.com/content/ist/nipdf/2014/00002014/00000001/art00005] on Sep. 15, 2015, 1 page.

Watanabe et al., "High Quality, High Speed, Next-Generation Inkjet Technology with Scalability from Serial Printheads to Lineheads," Jan. 1, 2014, 1 page. (Abstract Only).

* cited by examiner

PRINTHEAD

BACKGROUND

Printing devices contain a number of printheads used to dispense ink or another jettable fluid onto a print medium. The printheads include a number of dies that are precision dispensing devices that precisely dispense the jettable fluid to form an image on the print medium. The jettable fluid may be delivered via a fluid slot defined in the print head to an ejection chamber beneath a nozzle. Fluid may be ejected from the ejection chamber by, for example, heating a resistive element. The ejection chamber and resistive element form the thermal fluid ejection device of a thermal inkjet (TIJ) printhead. The printing devices may, however, use any type of digital, high precision liquid dispensing system, such as, for example, two-dimensional printing systems, three-dimensional printing systems, digital titration systems, and piezoelectric printing systems, among other types of printing devices.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
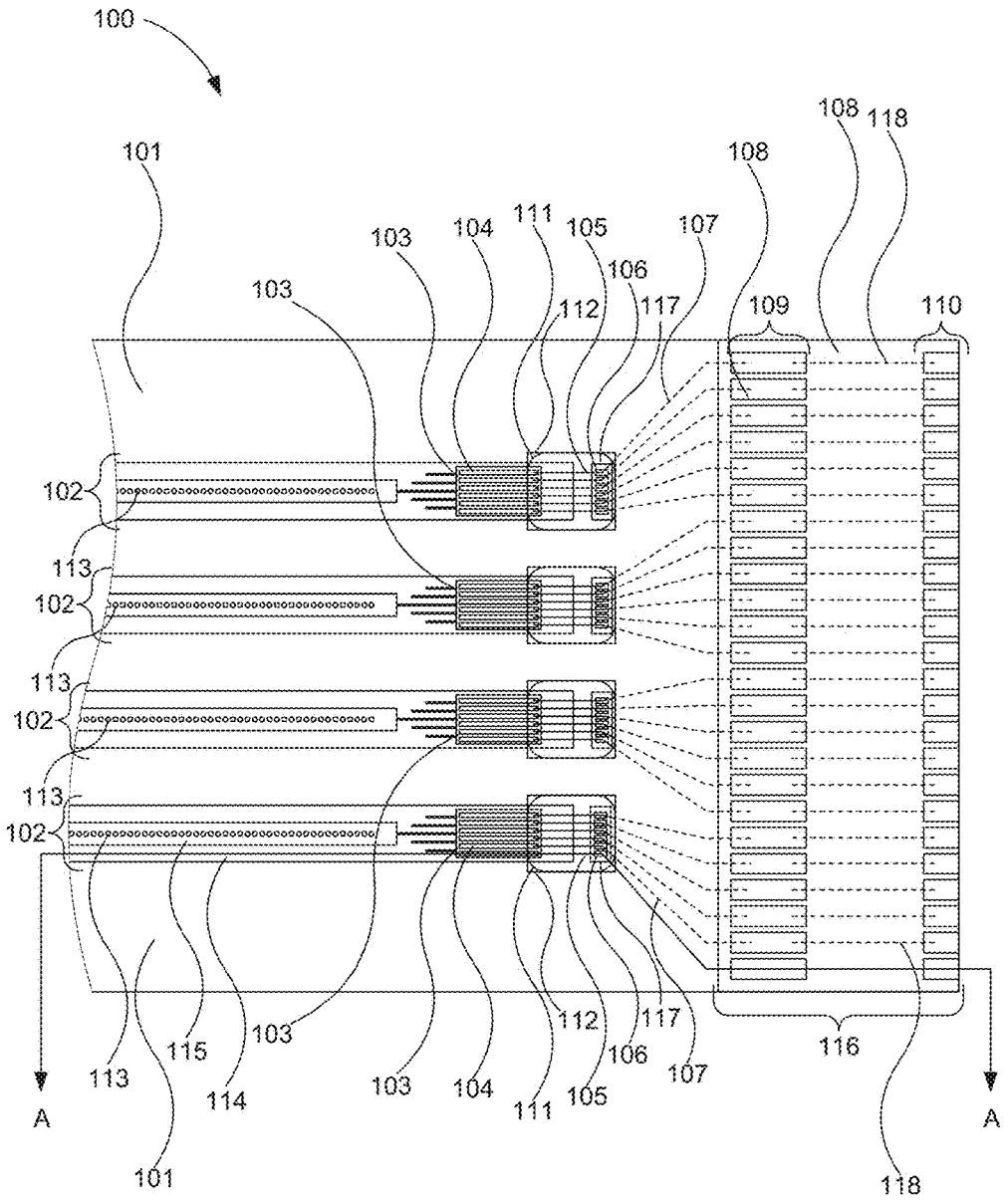
FIG. 1 is a diagram of a thermal inkjet (TIJ) printhead die, according to one example of the principles described herein.

As described above, a thermal inkjet (TIJ) printhead includes a number of TIJ dies. Each TIJ die includes a number of slivers. A die sliver includes a thin silicon, glass or other substrate having a thickness on the order of approximately 650 μm or less. The TIJ slivers may each include a number of fluid ejection devices such as the above-mentioned resistive heating elements on a surface of the slivers. Jettable fluid may flow to the ejection devices of the slivers through a number of fluid slots formed in the substrate between opposing substrate surfaces.

While thermal inkjet (TIJ) devices are described throughout the examples herein, any type of digital, high precision liquid dispensing system may utilize these examples. For example, the printhead may include any two-dimensional (2D) printing elements or devices, any three-dimensional (3D) printing elements or devices, digital titration elements or devices, either thermos-resistor type or piezoelectric type printing elements or devices, other types of digital, high precision liquid dispensing system, or combinations thereof. These various types of liquid dispensing systems may dispense a myriad of types of liquids including, for example, inks, 3D printing agents, pharmaceuticals, lab fluids, and bio-fluids, among other dispensable liquids. The 3D printing agents may include, for example, polymers, metals, adhesives, 3D inks, among others While fluid slots within a printhead die effectively deliver fluid to the fluid ejection elements, the fluid slots occupy valuable silicon real estate and add significant processing cost in their fabrication. Lower printhead die costs may be achieved in part through shrinking the die size. However, a smaller die size results in a tighter slot pitch and/or a narrower slot width in the silicon substrate, which adds excessive assembly costs associated with integrating the smaller die into the TIJ printhead. Further, removing material from the substrate to form an ink delivery slot structurally weakens the printhead die. Thus, when a single printhead die has multiple slots to improve print quality and speed in a single color printhead die, or to provide different colors in a multicolor printhead die, the printhead die becomes increasingly fragile with the addition of each slot. Thus, one constraint within a TIJ printhead is that higher TIJ die separation ratios or lower die costs are proportional to tighter slot pitch or fluid slot width. From a cost point of view, a fluid slot may occupy useful die space and may have significant processing cost.

Stating it in another way, reducing the cost of inkjet printhead dies may include shrinking the die size and reducing wafer costs. The die size may depend on the pitch of fluid delivery slots formed through the silicon substrate that deliver jettable fluid from a reservoir on one side of the die to fluid ejection elements of the slivers on another side of the die. Therefore, some methods to shrink the die size may involve reducing the slot pitch and size through a silicon slotting process that may include, for example, laser machining, anisotropic wet etching, dry etching, other material removal methods, or combinations thereof. However, the silicon slotting process adds considerable manufacturing costs to the printhead die. Further, as die sizes have decreased, the costs and complexities associated with integrating the smaller dies into an inkjet printhead have begun to exceed the savings gained from the smaller dies. Furthermore, as die sizes have decreased, the removal of die material to form ink delivery slots has had an increasingly adverse impact on die strength, which can increase die failure rates.

In one example, an overmold of epoxy mold compound (EMC) may be used to hold multiple TIJ slivers of a printhead die in place. The inexpensive molded substrate formed by the EMC also provides physical support for interconnect traces, supports wire bonding, and enables TAB bonding in various examples. Overmolded printhead die have three times a reduction in cost. Further, the overmolded printhead die simplify the printhead assembly process since chiclets or other fluid distribution manifolds or fluidic interposers are no longer needed within the printhead. To further reduce the cost, electrical interconnects are extended from the slivers to printed circuit boards (PCB) or lead frames. The PCBs or lead frames connect the slivers to the edge of the die so the printhead can be connected to an electrical contact of a printing device directly instead of using expensive tape-automated bonding (TAB) circuits or surface-mounted technology (SMT) connectors. Thus, the overmolded slivers and their respective electrical interconnects greatly simplify the printhead design and assembly process.

Thus, examples described herein provide a thermal inkjet (TIJ) printhead. The TIJ printhead includes a number of inkjet slivers molded into a moldable substrate. The overmolded inkjet slivers form at least one TIJ die. The TIJ printhead also includes a number of wire bonds electrically coupling the inkjet slivers to a side connector. The side connector electrically couples the inkjet slivers to a controller of a printing device.

In one example, the side connector includes a printed circuit board (PCB) side connector. In this example, the PCB side connector may be molded into the moldable substrate.

In another example, the side connector includes a lead frame embedded into the moldable substrate. In this example, the lead frame includes a number of electrical traces from the wire bonds and a number of connection pads coupled to the electrical traces. The connection pads electrically couple the inkjet slivers to the controller of the printing device. The TIJ printhead may further include an encapsulating cover disposed on the wire bonds.

In one example, the side connector is electrically coupled to the inkjet slivers at an edge of each of the inkjet slivers. Further, in one example, the moldable substrate is an epoxy molding compound (EMC). Epoxy molding compound (EMC) is broadly defined herein as any material including at least one epoxide functional group. In one example, the EMC is a self-cross-linking epoxy. In this example, the EMC may be cured through catalytic homopolymerization. In another example, the EMC may be a polyepoxide that uses a co-reactant to cure the polyepoxide. Curing of the EMC in these examples forms a thermosetting polymer with high mechanical properties, and high temperature and chemical resistance.

Examples described herein also provide a thermal inkjet (TIJ) printhead die. The TIJ printhead die includes a moldable substrate, a number of inkjet slivers molded into the moldable substrate, and a number of electrical wire leads connecting the slivers to an edge connector coupled to the moldable substrate. In one example, the edge connector includes a printed circuit board (PCB) embedded within the moldable substrate, a first set of connectors coupled to the PCB to couple the PCB to the inkjet slivers via the wire leads, and a second set of connectors coupled to the PCB to couple the PCB to a printer controller.

The TIJ printhead may further include an encapsulating material disposed on the wire bonds. In addition, the TIJ printhead die may further include a protective film disposed on the encapsulating material to maintain a low profile of the encapsulating material.

Examples described herein also provide a method of manufacturing a thermal inkjet (TIJ) die. The method may include overmolding a number of inkjet slivers into a moldable substrate, the overmolded inkjet slivers forming at least one TIJ die, electrically coupling a first end of a number of wire bonds to the inkjet slivers, and electrically coupling a second end of the wire bonds to a side connector coupled to an edge of the at least one TIJ die. In one example, overmolding the number of inkjet slivers into the moldable substrate includes overmolding a printed circuit board (PCB) with the number of inkjet slivers into the moldable substrate.

In one example, the method may further include encapsulating the wire bonds with an encapsulating material to preclude exposure of the wire bonds to the environment. Further, in one example, the method may include depositing a protective film on the encapsulating material to maintain a low profile of the encapsulating material.

As used in the present specification and in the appended claims, the terms "printhead" or "printhead die" is meant to be understood broadly as the part of an inkjet printer or other inkjet type dispenser that can dispense jettable fluid from a number of nozzle openings. A printhead includes a number of printhead dies, and a printhead die includes a number of die slivers. A printhead and printhead die are not limited to dispensing ink and other printing fluids, but instead may also dispense other fluids for uses other than printing.

Further, as used in the present specification and in the appended claims, the term "sliver" or "die sliver" means any sub-element of a printhead die that ejects jettable fluid. In one example, the slivers may include thin silicon or glass substrate having a thickness of approximately 200 μm and a ratio of length to width (L/W) of at least three. The slivers may also include an epoxy-based negative photoresist material such as SU-8 layered on the silicon or glass substrate that makes up the nozzles of the sliver.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is a diagram of a thermal inkjet (TIJ) printhead die (100), according to one example of the principles described herein. In the example of FIG. 1, the TIJ printhead die (100) includes a number of die slivers (102) overmolded into a moldable substrate (101). In one example, the moldable substrate is made of an epoxy mold compound (EMC). In this example, the slivers (102) are arranged with respect to one another according to a desired sliver (102) arrangement, and uncured EMC is deposited around the slivers (102). The EMC may include any polyepoxides that include any reactive prepolymers and polymers which contain epoxide groups. The EMC may be reacted (i.e., cross-linked) either with themselves through catalytic homopolymerisation, or with a wide range of co-reactants including polyfunctional amines, acids and acid anhydrides, phenols, alcohols, thiols, other co-reactants, or combinations thereof. These co-reactants may be referred to as hardeners or curatives, and the cross-linking reaction may be referred to as curing. Reaction of polyepoxides with themselves or with polyfunctional hardeners forms a thermosetting polymer, often with high mechanical properties, and temperature, and chemical resistance.

As mentioned above, a die sliver includes a thin silicon, glass, or other substrate having a thickness of approximately 650 μm or less, and may also have a ratio of length to width (L/W) of at least three. In one example, the number of slivers (102) included within a TIJ printhead die (100) is equivalent to the number of colors the TIJ printhead die (100) ejects. In the example of FIG. 1, four slivers (102) are included within the TIJ printhead die (100), and may, for example, include slivers (102) for cyan (C), magenta (M), yellow (Y), and black (K). However, any color model or colors may be represented by the slivers (102).

As depicted in FIG. 1, each sliver (102) includes a number of nozzles (113) defined in an epoxy-based negative photoresist (115) where portions of the negative photoresist exposed to ultraviolet (UV) radiation become cross-linked, while the remainder of the film remains soluble and can be washed away during development. In one example, the negative photoresist is SU-8. The nozzles (113) are coupled to a silicon substrate that includes a number of ink feed slots defined therein. An additional portion of epoxy-based negative photoresist (114) may be included in the slivers (102) to act as a dam to prevent the molding compound of the EMC (101) from contacting the connection pad (103) or other electrical connections. This additional portion of epoxy-based negative photoresist (114) that surrounds the connection pad (103) regions prevent excess flash molding material from entering the connection pad (103) regions during a molding process.

Further, each sliver (102) includes at least one ejection chamber beneath each nozzle. The ejection chamber is fluidically coupled to a number of slots defined within the moldable substrate (101) beneath the sliver through which jettable fluid flows to the ejection chambers and out the nozzles during a firing event of the jettable fluid. Thus, molded fluid flow structures, such as the molded inkjet printhead (100), do not include fluid slots formed through the die sliver substrate. Instead, each die sliver (102) is molded into the monolithic moldable substrate (101) that provides fluidic fan-out through fluid channels formed into the moldable substrate (101) at the back surface of the slivers (102). Thus, a molded printhead structure avoids significant costs otherwise associated with die slotting processes and the related assembly of slotted dies into manifold features (e.g., chiclets) of the printhead (100).

Fluid slots formed into the moldable substrate (101) enable jettable fluid to flow to the back surface of each die sliver (102). Fluid/ink feed holes (IFH) formed through the die sliver (102) from its back surface to its front surface enable the fluid to flow through the sliver (102) to the ejection chambers on the front surface such as the ejection chambers including the resistive heating elements described above. The jettable fluid is ejected from the slivers (102) of the molded printhead (100) through nozzles fluidically coupled to the fluid ejection chambers.

In one example, the aspects described herein may be implemented in a printhead bar such as those used in a page-wide array. In this example, a print bar may include a number of molded printhead dies (102) embedded in the moldable substrate (101). Each molded printhead die includes a number of die slivers (102) having a front surface and a back surface exposed outside of the molding. The back surface is to receive fluid and the front surface is to dispense fluid that flows from the back surface to the front surface through fluid feed holes in the die sliver.

In one example, the molded printhead dies (100) may be arranged along a print bar or a page-wide array. In this example, the molded printhead dies (100) may be arranged end to end along the length of a printhead in a number of different configurations. In one example, the molded printhead dies (100) may be arranged in an inline configuration. In another example, the molded printhead dies (100) may be arranged in a staggered configuration where the slivers (102) are aligned with respect to one another but the dies (100) are staggered along the longitudinal axis of print bar. In still another example, the molded printhead dies (100) may be arranged in a rotated configuration where the slivers (102) are aligned with respect to one another but the dies (100) are rotated with respect to a longitudinal axis of the print bar. In yet another example, the molded printhead dies (100) may be arranged in a slanted configuration where the slivers (102) are arranged in a slanted arrangement with respect to one another but the dies (100) are aligned with respect to a longitudinal axis of the print bar. In still another example, the molded printhead dies (100) may be arranged in a stitching configuration where a number of the dies (100) overlap an adjacent a number of the dies. In this example, the overlap of the dies (100) allows for nozzle stitching of those nozzles of the slivers (102) of the die (100). Stitching of the nozzles may be accomplished, in one example, by timing the firing of any overlapping nozzles such that the combined firing of ejection fluid from the overlapped nozzles does not eject any more or less jettable fluid than other non-overlapping nozzles.

In another example, the molded printhead dies (100) may be included within a print cartridge. In this example, a single printhead die (100) may be included in the print cartridge. In the examples described herein, a printed circuit board (PCB) may be embedded or coupled to the edge of the moldable substrate (101). In one example, the PCB is a FR-4 (fire retardant-4) grade PCB. An FR-4 grade PCB denotes a glass-reinforced epoxy laminate sheet. FR-4 PCB is a composite material composed of woven fiberglass cloth with an epoxy resin binder that is flame resistant or self-extinguishing. As mention above, the "FR-4" designation denotes that safety of flammability of FR-4 is in compliance with the standard UL94V-0. In one example, FR-4 may be created from a number of materials including epoxy resin, woven glass fabric reinforcement, brominated flame retardant, or combinations thereof, and is a versatile high-pressure thermoset plastic laminate grade with good strength to weight ratios. With near zero water absorption, an FR-4 grade PCB may be used as an electrical insulator possessing considerable mechanical strength, and retains its high mechanical values and electrical insulating qualities in both dry and humid conditions. Further, an FR-4 grade PCB substrate has good fabrication characteristics. Details regarding an embedded or coupled PCB will be described below.

Figure 12:
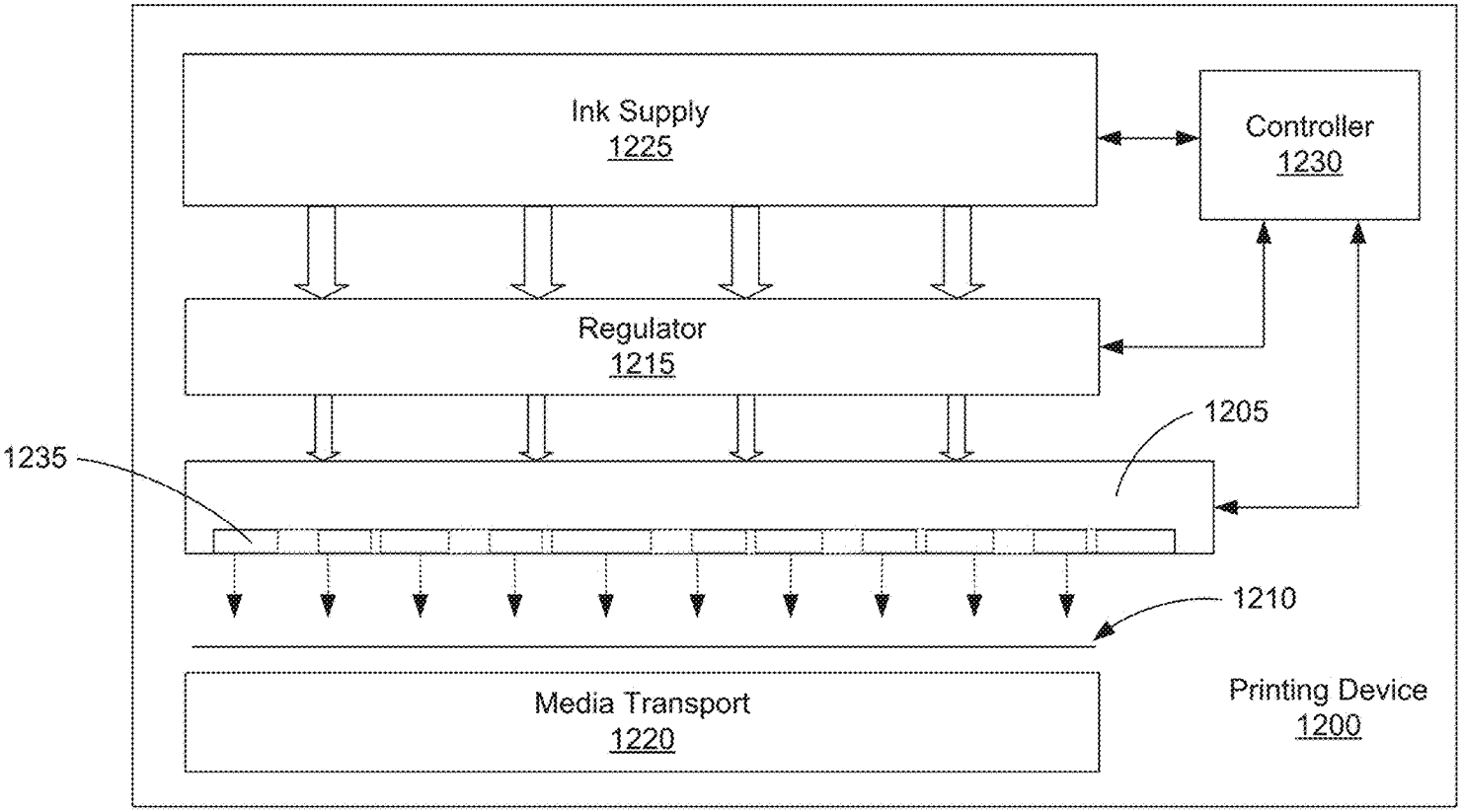
FIG. 12 is a block diagram of a printing device utilizing TIJ printhead dies, according to one example of the principles described herein.

In one example, the slivers (102) included in the printhead die (100) each include a number of connection pads. However, the slivers (102), as molded within the moldable substrate (101), are unable to electrically couple to a printing device (FIG. 12, 1200) into which the printhead die (100) is incorporated. In this manner, the slivers (102) are unable to receive electrical signals from a controller (FIG. 12, 1230) of the printing device (FIG. 12, 1200). Therefore, FIG. 1 depicts one example of an edge connector (116) for use in electrically coupling the slivers (102) to the printing device (FIG. 12, 1200). In the example of FIG. 1, a printed circuit board (PCB) is coupled to or molded into the moldable substrate (101). The PCB (108) acts as a substrate for the edge connector (116) in the example of FIG. 1.

Figure 2:
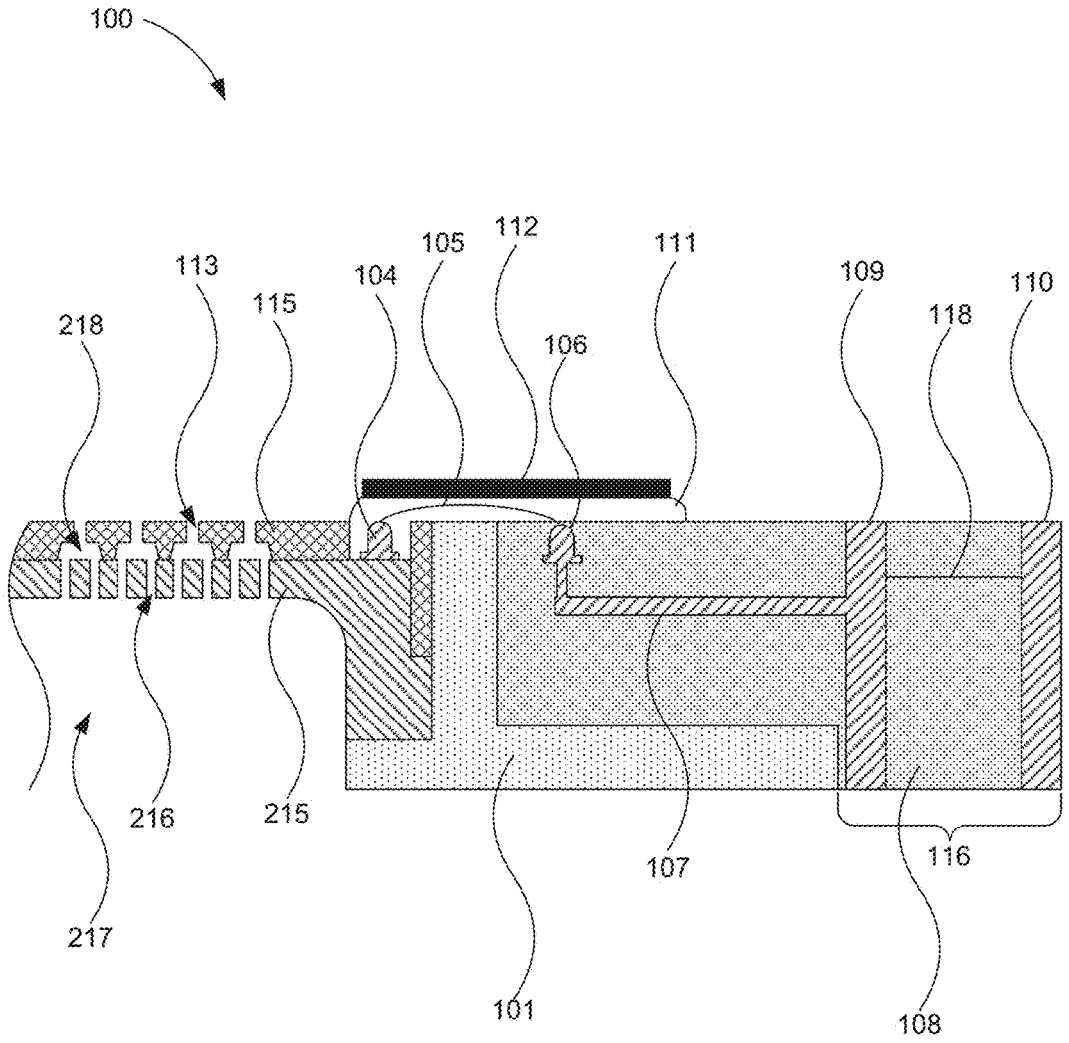
FIG. 2 is a cross-sectional diagram of the TIJ printhead die of FIG. 1 along line A depicted in FIG. 1, according to one example of the principles described herein.

The printhead die (100) of FIG. 1 further includes a number of bond wires (105) coupling a number of first electrical connections (104) of a connection pad (103) to a number of second electrical connections (106). In one example, the second electrical connections (106) are recessed below a plane defined by the surface of the slivers (102) with a via (117) defined within the embedded PCB (108). In this example, a number of traces (107) may be embedded into the embedded PCB (108) to couple the second electrical connections (106) to a number of third electrical connections (109) located on and edge portion of the PCB (108). A number of PCB traces (118) are included in the PCB (108). The PCB traces (118) couple the third electrical connections (109) to a number of fourth electrical connections (110). In one example, the third electrical connections (109), PCB traces (118), and fourth electrical connections (110) are combined into a single connection. In this example, the embedded PCB (108) is shorter because the length of the PCB (108) is not taken up by, for example, the PCB traces (118), and fourth electrical connections (110). In the example of FIGS. 1 and 2, the fourth electrical connections (110) are coupled to a connector of the printing device (FIG. 12, 1200) in order to provide electrical communication between a controller (FIG. 12, 1230) of the printing device (FIG. 12, 1200) and the printhead die (100).

In one example of FIG. 1, the wire bonds (105) may directly couple the first electrical connections (104) of the connection pad (103) to the fourth electrical connections (110). In this manner, the second electrical connections (106), the via (117), the traces (107), the third electrical connections (109), and the PCB traces (118) are not used, a smaller PCB (108) is coupled to the moldable substrate (101), and the length of the printhead die (100) is shortened.

In the example of FIG. 1, an encapsulant (111) may be placed over the wire bonds (105) to eliminate exposure of the wire bonds (105) to the surrounding environment. The wire bonds (105), as depicted in FIG. 1 are located on a side of the printhead die (100) from which the jettable fluid is ejected from the nozzles (113). This means that the wire bonds (105) are exposed to possible friction from a print media passing through the printing device (FIG. 12, 1200), dust, and other contaminants from the print media and other sources, and moisture from the surrounding air. In order to eliminate possible contamination or degradation to the wire bonds (105), the encapsulant (111) may be placed on the wire bonds (105).

Further, a protective film (112) may be placed on the encapsulant (111). The protective film (112) causes the encapsulant (111) to be sandwiched between a number of surfaces of the printhead die (100) and the protective film (112). This, in turn, causes the encapsulant (111) and protective film (112) to maintain a low profile so that the encapsulant (111) does not protrude from the surface of the printhead (100) to a degree at which the encapsulant (111) disrupts printing operations.

FIG. 2 is a cross-sectional diagram of the TIJ printhead die (100) of FIG. 1 along line A depicted in FIG. 1, according to one example of the principles described herein. The cross-sectional diagram of FIG. 2 provides insight into the various portions of the printhead die (100). As depicted in FIG. 2, the thin silicon or glass substrate (215) is disposed beneath the negative photoresist material (213) (e.g. SU-8) in which the nozzles (113) are defined. A number of channels (216) are defined in the substrate (215) to allow for the passage of jettable fluid from the slot (217) to the ejection chambers (218) beneath the nozzles (113). The negative photoresist material (213) and the substrate (215) form the sliver (FIG. 1, 102), and are overmolded or molded into the moldable substrate (101).

Again, in order to provide electrical connectivity between the slivers (102) and a controller (FIG. 12, 1230) of the printing device (FIG. 12, 1200), a number of wire bonds (105) electrically couple the first electrical connections (104) of the connection pad (FIG. 1, 103) of the slivers (102) to a number of second electrical connections (106) within an embedded PCB (108). The traces (107) then electrically couple the second electrical connections (106) to the third electrical connections (109) located on the embedded PCB (108) acting as the substrate for the edge connector (116). The PCB traces (118) couple the third electrical connections (109) to a number of fourth electrical connections (110).

In an example where the wire bonds (105) directly couple the first electrical connections (104) of the connection pad (103) to the fourth electrical connections (110), the wire bonds (105) reach to the fourth electrical connections (110), and the encapsulant (111) is placed over the wire bonds (105) for the entire length of the wire bonds (105). Further, as depicted in FIG. 2, the protective film (112) causes a profile of the encapsulant (111) to be reduced, and ensures that a low profile along the printhead die (100) is maintained.

Figure 3:
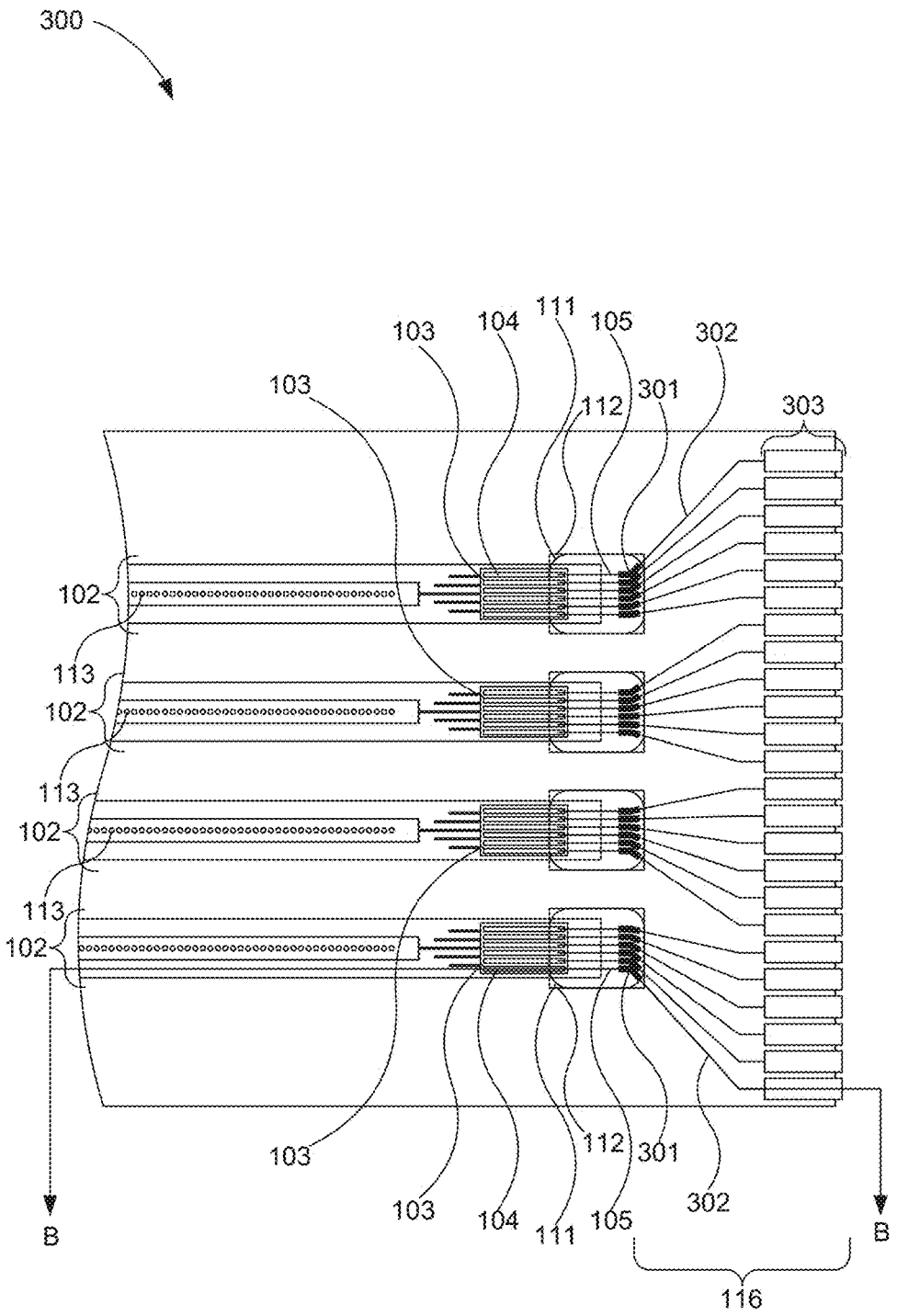
FIG. 3 is a diagram of a TIJ printhead die, according to another example of the principles described herein.
Figure 4:
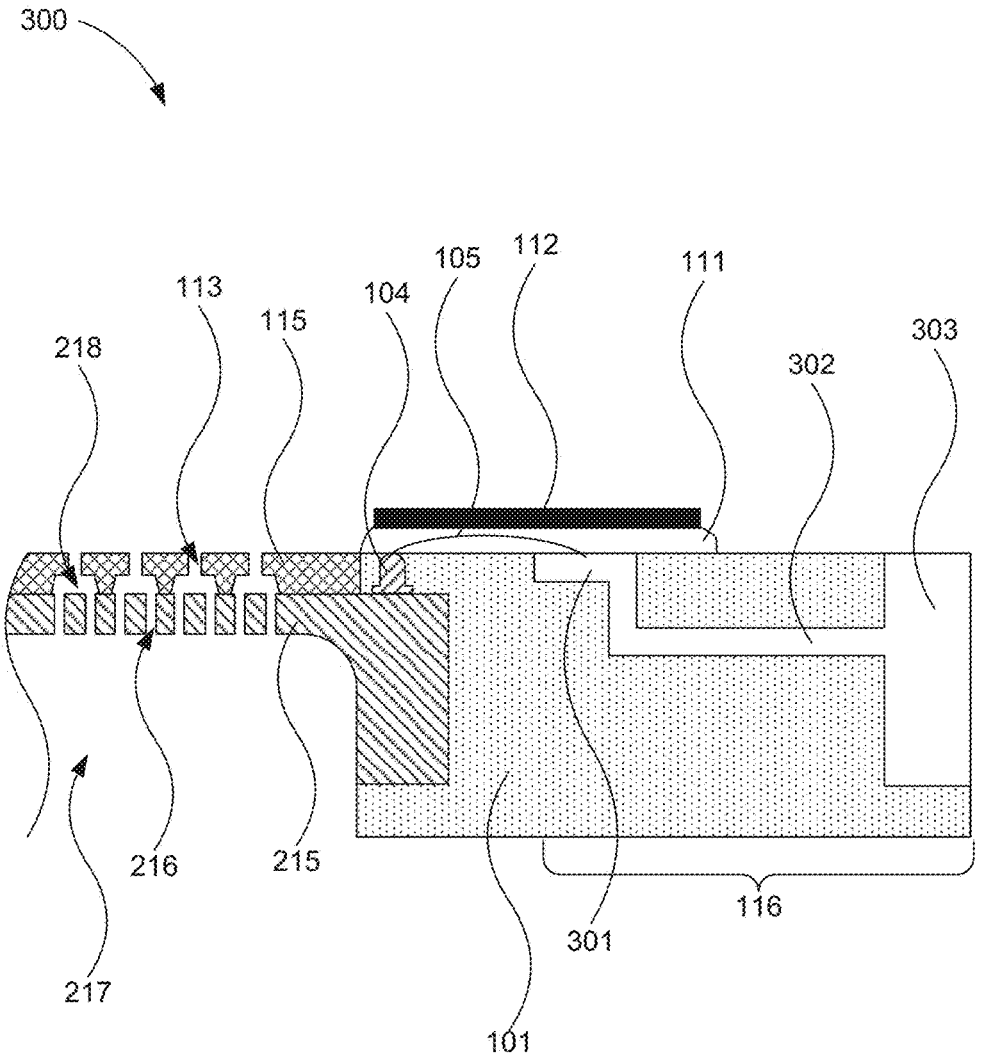
FIG. 4 is a cross-sectional diagram of the TIJ printhead die of FIG. 3 along line B depicted in FIG. 3, according to one example of the principles described herein.

FIG. 3 is a diagram of a TIJ printhead die (300), according to another example of the principles described herein. FIG. 4 is a cross-sectional diagram of the TIJ printhead die (300) of FIG. 3 along line B depicted in FIG. 3, according to one example of the principles described herein. Similarly, numbered elements within FIGS. 3 and 4 with respect to FIGS. 1 and 2 are described above. The example of the printhead die (300) of FIGS. 3 and 4 differ from the example of FIGS. 1 and 2 in that the edge connector (116) includes a lead frame embedded within the moldable substrate (101). The lead frame includes a number of first portions (301) that are coupled to the distal ends of the bond wires (105) with respect to the first electrical connections (104) of the connection pads (103). An intermediary portion (302) of the lead frame connects the first portions (301) to edge portions (303). The edge portions (303) are coupled to a connector of the printing device (FIG. 12, 1200) in order to provide electrical communication between a controller (FIG. 12, 1230) of the printing device (FIG. 12, 1200) and the printhead die (100).

Figure 5:
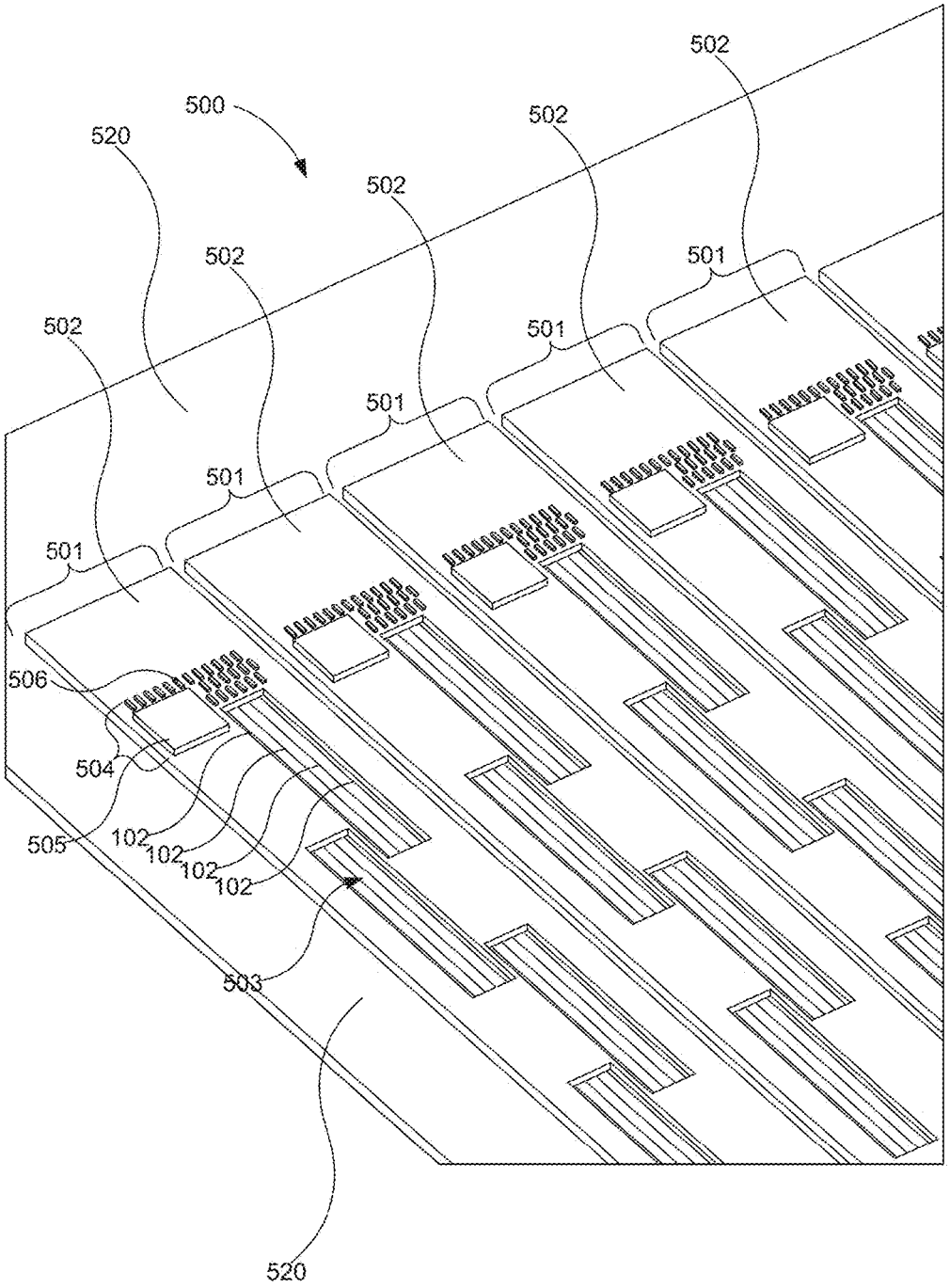
FIG. 5 is a diagram of a number of TIJ printheads in a first stage of fabrication, according to one example of the principles described herein.

FIGS. 5 through 10 depict a TIJ printhead fabrication process. Specifically, FIG. 5 is a diagram of a number of TIJ printheads (501) in a first stage (600) of fabrication, according to one example of the principles described herein. As depicted in FIG. 5, a number of PCB substrates (502) are placed on a panel substrate (520) as a staging area for later fabrication processes. A number of slivers (102) are arranged within a number of die voids (503) according to how the slivers (102) are to be arranged with respect to one another within a die (100, 300). In the example of FIG. 5, the die (100, 300) are arranged in a staggered configuration where the slivers (102) are aligned with respect to one another but the dies (100) are staggered along the longitudinal axis of printhead (501) as described above. However, the slivers (102) within a die (100, 300), dies (100, 300) within the printhead (501), or combinations thereof may be arranged in any configuration.

FIG. 5 depicts a side of each of the printheads (501) opposite of a side that includes the nozzles (FIGS. 1-4, 113). Thus, the side of the printheads (501) depicted in FIG. 5 may be referred to as a second side of the printheads (501) whereas the side of the printheads (501) depicted in FIGS. 1-4 is a first side. Each of the printheads (501) may include a number of surface-mount technology (SMT) devices (504) including, for example, application specific integrated circuits (ASIC) (505) and electrical interconnects (506) that are used to couple the printheads (501) to the printing device (FIG. 12, 1200) or other SMT devices (504).

Figure 6:
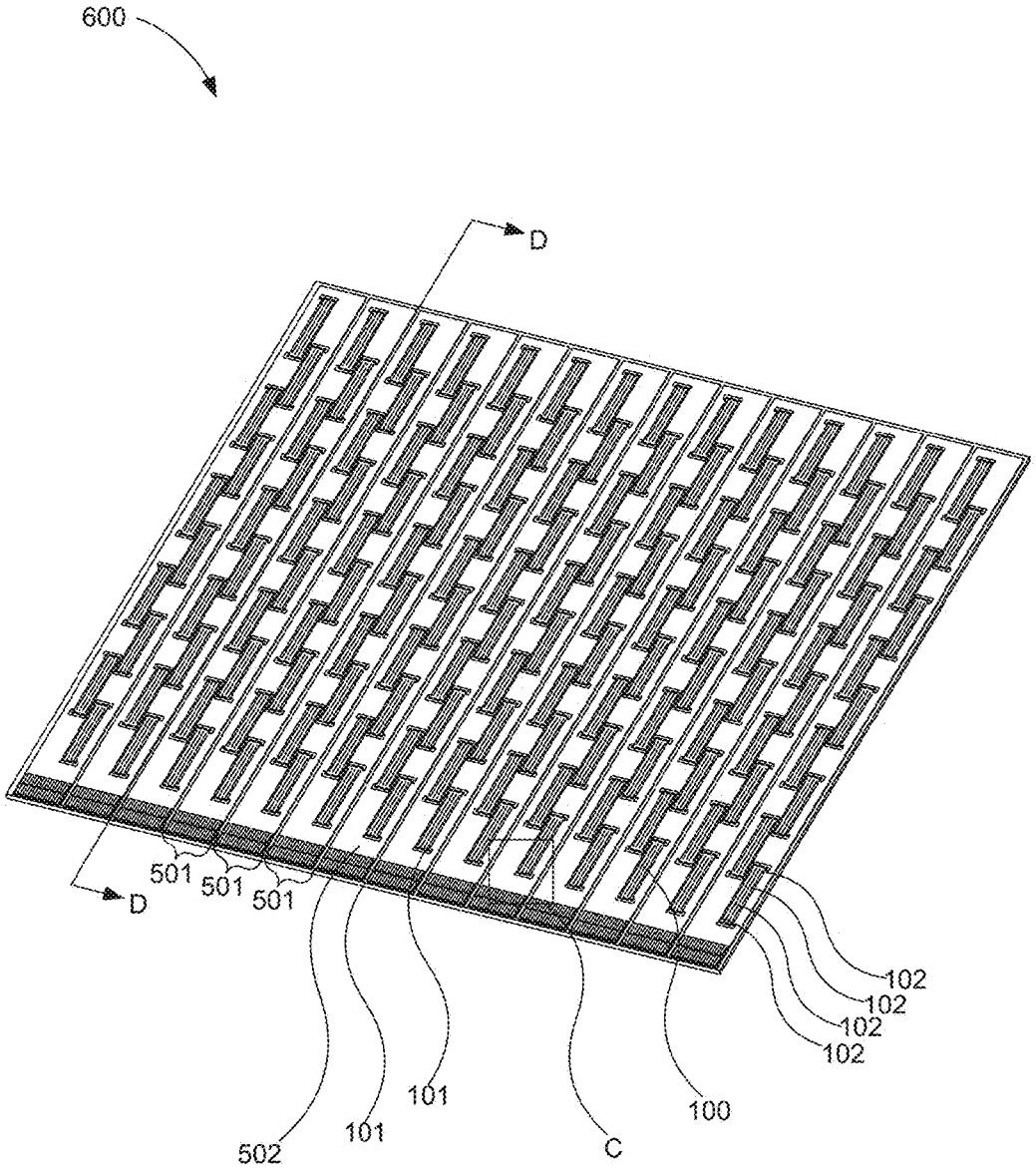
FIG. 6 is a diagram of a number of TIJ printheads in a second stage of fabrication depicting a first side of the TIJ printheads, according to one example of the principles described herein.
Figure 7:
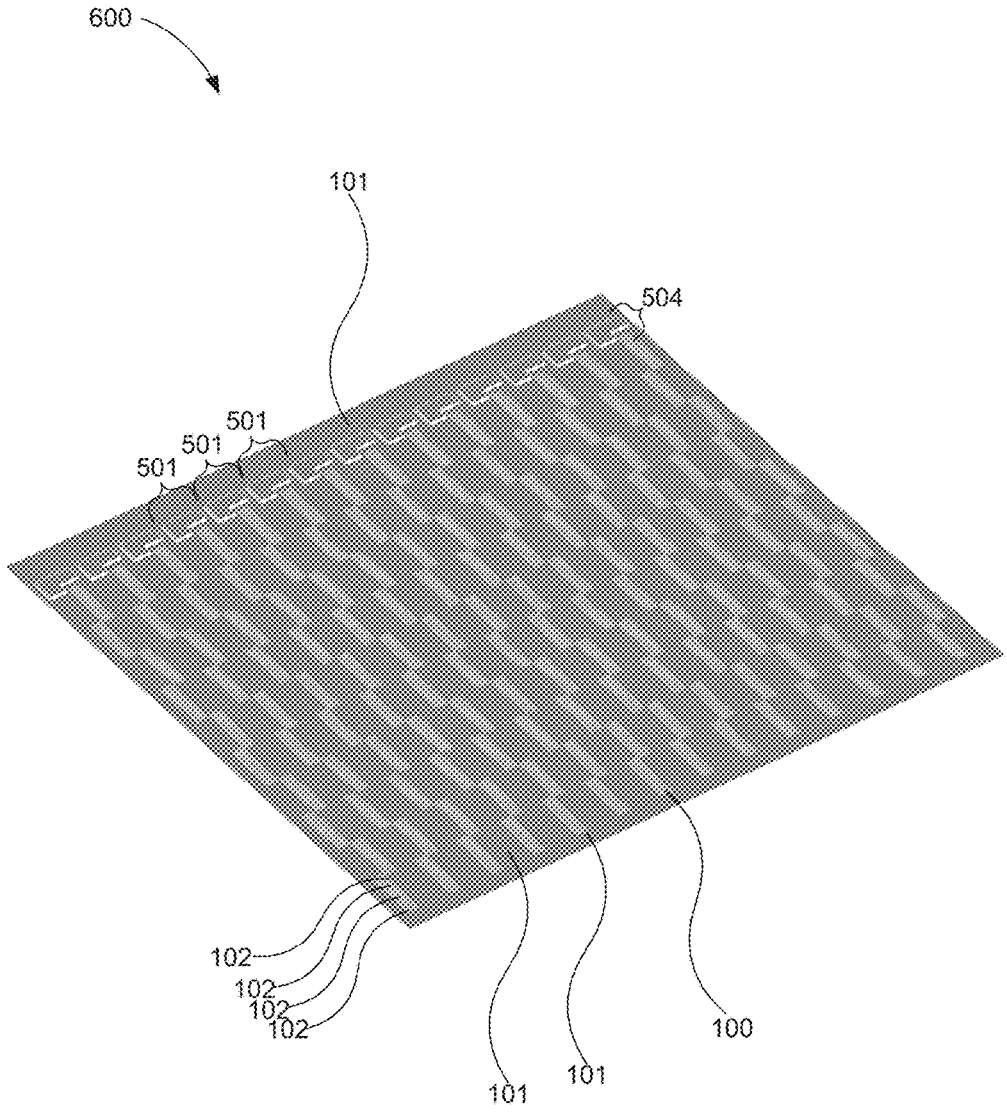
FIG. 7 is a diagram of a number of TIJ printheads in a second stage of fabrication depicting a second side of the TIJ printheads, according to one example of the principles described herein.
Figure 8:
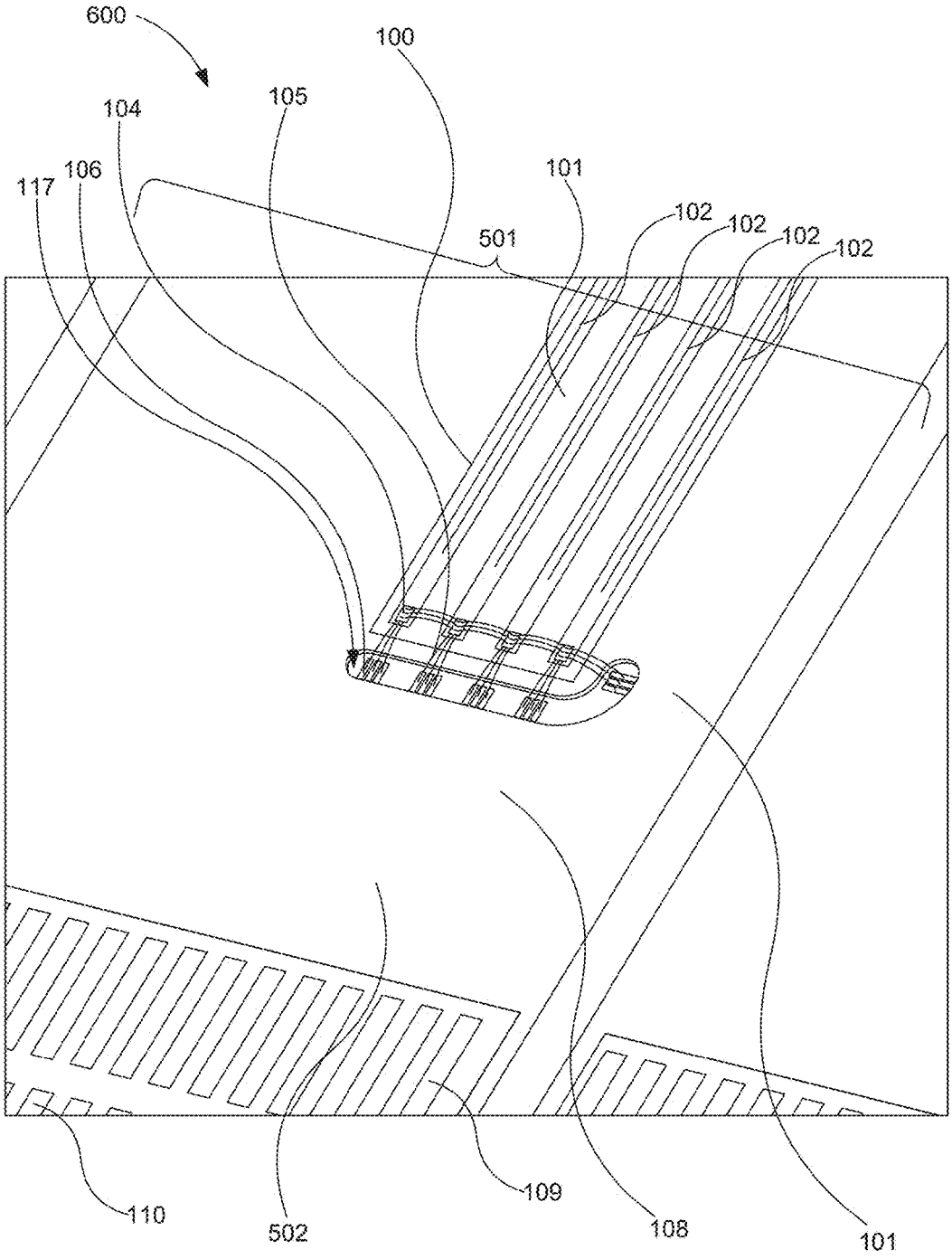
FIG. 8 is a diagram of one of the number of the TIJ printheads in a second stage of fabrication depicting the first side of the TIJ printheads as depicted in square C of FIG. 6, according to one example of the principles described herein.

FIG. 6 is a diagram of a number of TIJ printheads (501) in a second stage (600) of fabrication depicting a first side of the TIJ printheads (501), according to one example of the principles described herein. FIG. 7 is a diagram of a number of TIJ printheads (501) in a second stage (600) of fabrication depicting a second side of the TIJ printheads (501), according to one example of the principles described herein. FIG. 8 is a diagram of a number of TIJ printheads (501) in a second stage (600) of fabrication depicting the first side of the TIJ printheads as depicted in square C of FIG. 6, according to one example of the principles described herein. In FIGS. 6 through 8, the EMC (101) has been molded into the printheads (501) including between printheads (501), within the die voids (FIG. 5, 503) and between slivers (102) within the die voids (FIG. 5, 503). The panel substrate (520) is removed from the overmolded printheads (501).

In FIG. 7, the second side of the TIJ printheads (501) is depicted with the SMT devices (FIG. 5, 504), and the opposite side of the slivers (102) within the dies (100, 300). In one example, the EMC (101) covers a large portion of the second side of the TIJ printheads (501).

Again, FIG. 8 is a diagram of one of the number of the TIJ printheads (501) in a second stage (600) of fabrication depicting the first side of the TIJ printheads (501) as depicted in square C of FIG. 6, according to one example of the principles described herein. Although the example of FIGS. 1 and 2 is depicted in FIGS. 5 through 10, the example of FIGS. 3 and 4 may also be fabricated in a similar manner with the exception that the lead frame (301, 302, 303) is embedded in the moldable substrate (101). The via (117) defined within the embedded PCB (108) is depicted at an end of the die (100). The bond wires (105) electrically couple the first electrical connections (104) of a connection pad (FIG. 1, 103) to the second electrical connections (106). In this manner, the bond wires are exposed to the environment as described above.

Figure 9:
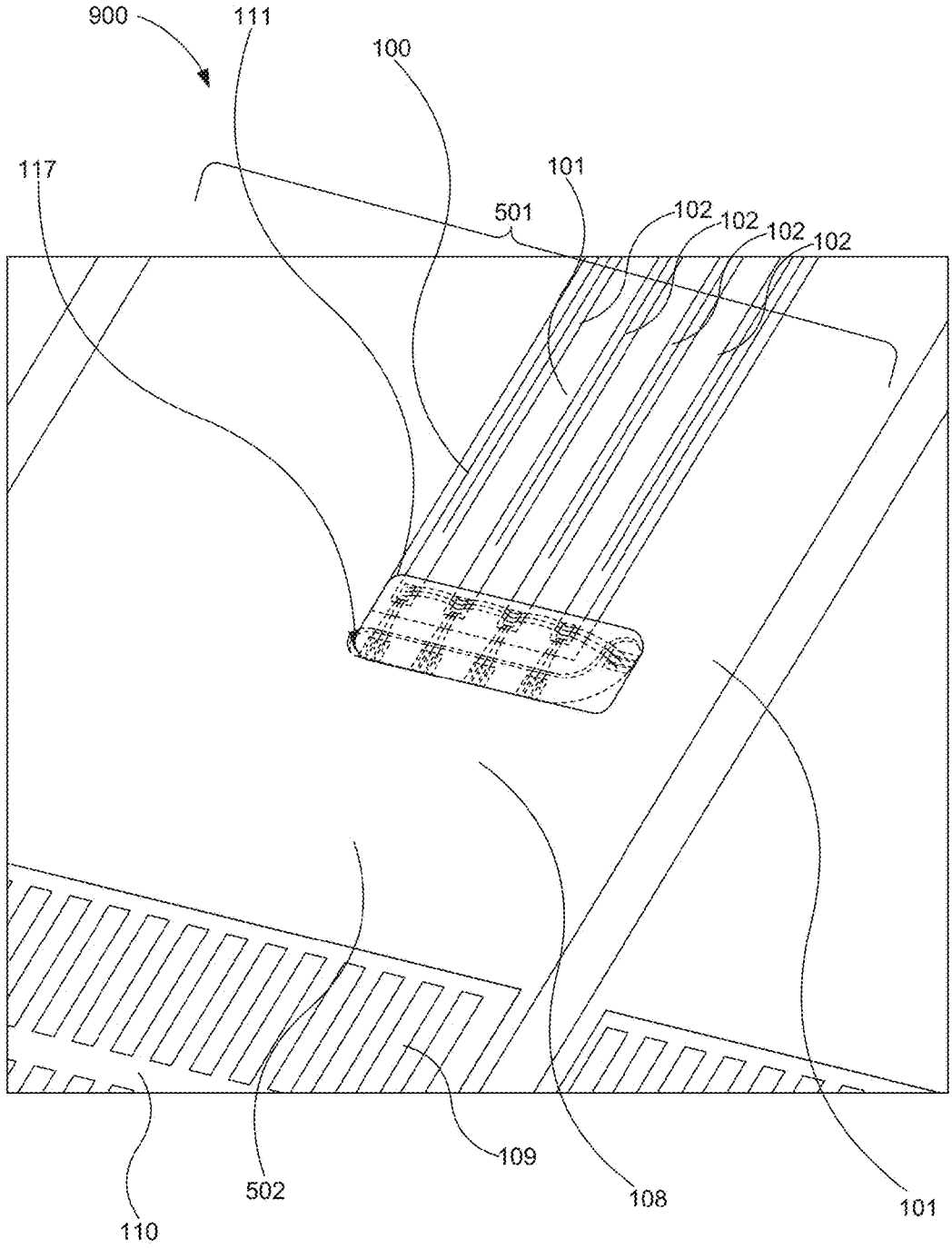
FIG. 9 is a diagram of one of the number of the TIJ printheads in a third stage of fabrication depicting the first side of the TIJ printheads as depicted in square C of FIG. 6, according to one example of the principles described herein.

FIG. 9 is a diagram of one of the number of the TIJ printheads (501) in a third stage (900) of fabrication depicting the first side of the TIJ printheads (501) as depicted in square C of FIG. 6, according to one example of the principles described herein. As depicted in FIG. 9, the encapsulant (111) may be placed over the wire bonds (105) to eliminate exposure of the wire bonds (105) to the surrounding environment. In the example of FIG. 9, the encapsulant (111) covers the bond wires (105) and fills at least a portion of the via (117).

Figure 10:
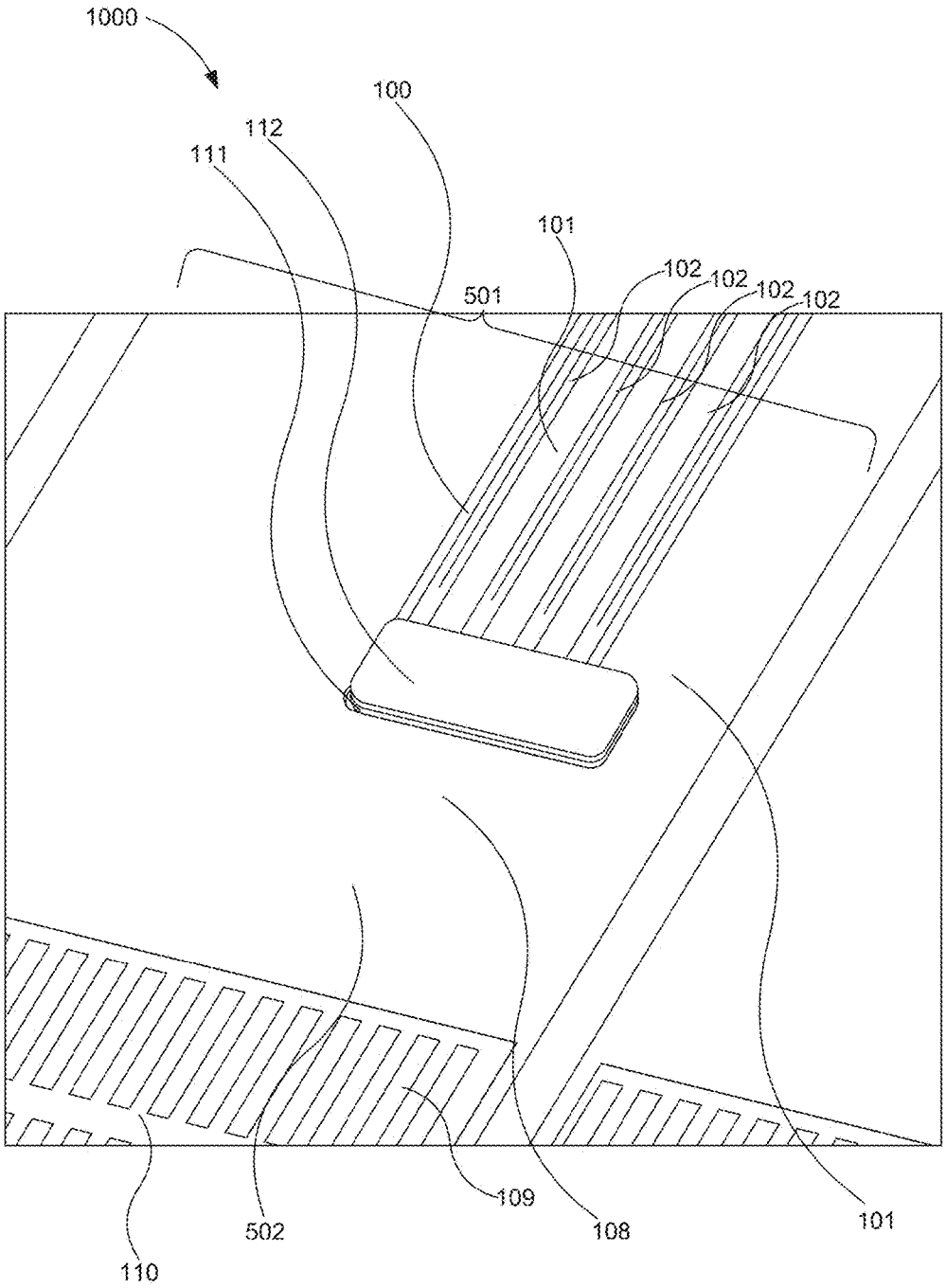
FIG. 10 is a diagram of one of the number of the TIJ printheads in a fourth stage of fabrication depicting the first side of the TIJ printheads as depicted in square C of FIG. 6, according to one example of the principles described herein.

FIG. 10 is a diagram of one of the number of the TIJ printheads (501) in a fourth stage (1000) of fabrication depicting the first side of the TIJ printheads (501) as depicted in square C of FIG. 6, according to one example of the principles described herein. As depicted in FIG. 10, the protective film (112) may be placed on the encapsulant (111) to sandwich the encapsulant (111) between a number of surfaces of the printhead die (100) and the protective film (112). This causes the encapsulant (111) and protective film (112) to maintain a low profile so that the encapsulant (111) does not protrude from the surface of the printhead (100) to a degree at which the encapsulant (111) disrupts printing operations.

Figure 11:
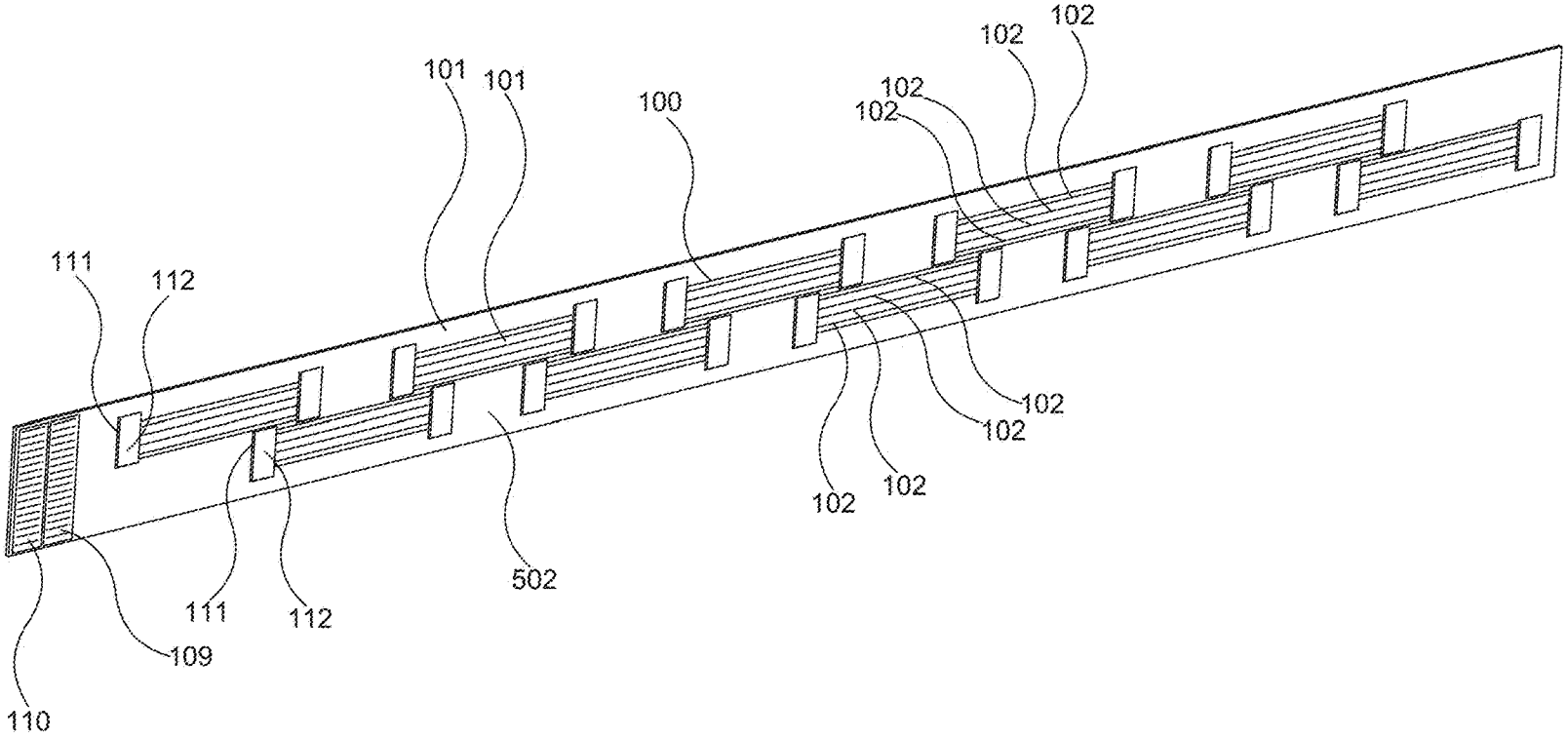
FIG. 11 is a diagram of a fabricated TIJ printhead, according to one example of the principles described herein.

FIG. 11 is a diagram of a fabricated TIJ printhead (501), according to one example of the principles described herein. FIG. 11 depicts a single printhead (501) separated from the remainder of the printheads (501) included within the same grouping as depicted in FIGS. 5 through 10. In one example, the TIJ printheads (501) depicted in FIGS. 5 through 10 may be separated from one another by cutting between the printheads (501) along line D depicted in FIG. 6. For example, a cutting saw may be used to cut and separate the printheads (501) from one another. In this manner, the completed printhead (501) depicted in FIG. 10 may be obtained. As mentioned above, each die (100) includes at least one sliver (102), and may include a plurality of slivers (102) based on a color model such as the cyan (C), magenta (M), yellow (Y), and black (K) color model.

FIG. 12 is a block diagram of a printing device utilizing TIJ printhead dies, according to one example of the principles described herein. The printing device (1200) may include a print bar (1205) that, in one example, spans the width of a print media (1210). The printer (1200) may further include flow regulators (1215) associated with the print bar (1205), a media transport mechanism (1220), ink or other ejection fluid supplies (1225), and a printer controller (1230). The controller (1230) may represent the programming, processor(s), associated data storage device(s), and the electronic circuitry and components needed to control the operative elements of a printer (1200) including the firing and operation of the TIJ printhead dies (100, 300). The print bar (1205) may include an arrangement of molded slivers (102) and dies (100, 200) for dispensing printing fluid onto a sheet or continuous web of paper or other print media (1210). The print bar (1205) in FIG. 12 includes multiple of molded slivers (102) and dies (100, 200) spanning print media (1210). However, different print bars (1205) are contemplated in the present specification that may include more or less molded slivers (102) and dies (100, 200) and may be fixed to a page-wide array bar as depicted in FIG. 12 or on a movable print cartridge.

Figure 13:
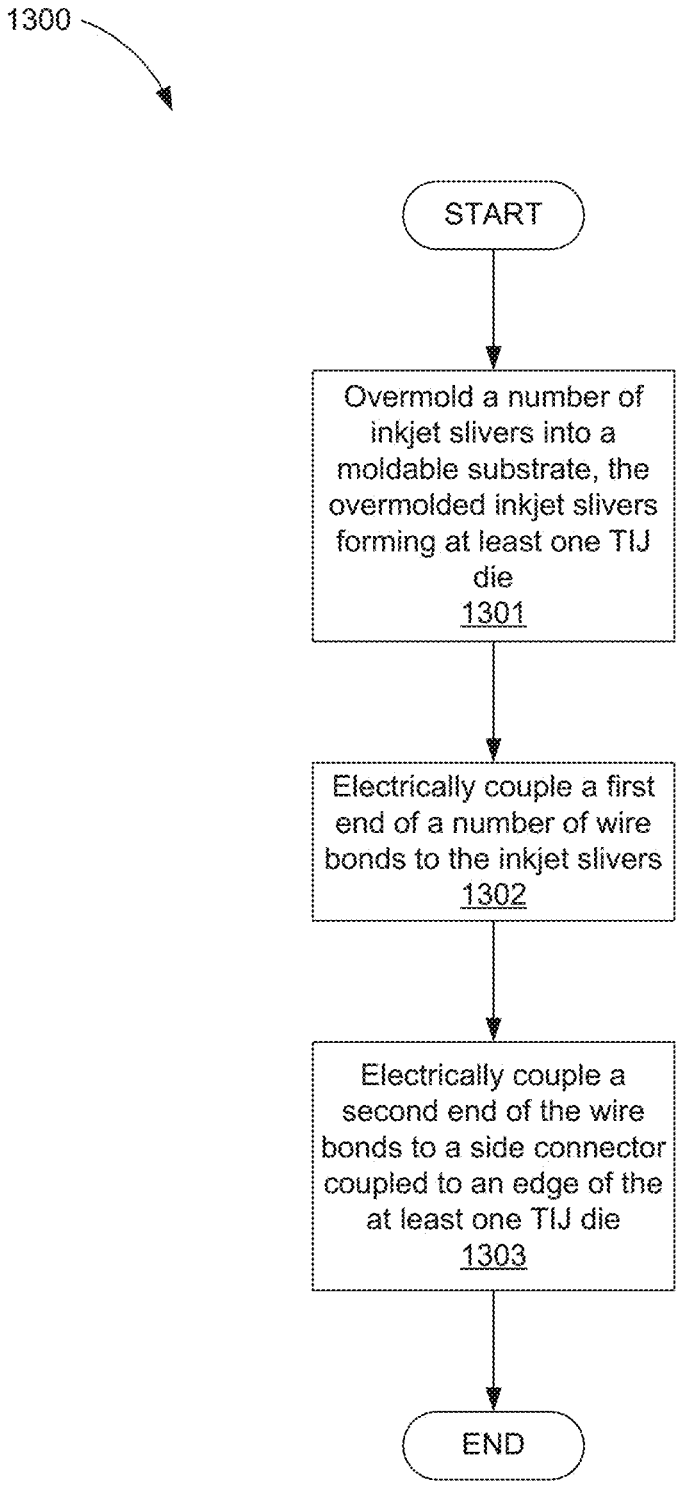
FIG. 13 is a flowchart depicting a method of manufacturing a TIJ printhead die, according to one example of the principles described herein.

FIG. 13 is a flowchart (1300) depicting a method of manufacturing a TIJ printhead (501), according to one example of the principles described herein. The method may begin by overmolding (block 1301) a number of inkjet slivers (102) into a moldable substrate (101). The overmolded inkjet slivers (102) form at least one TIJ die (100, 300). A first end of a number of wire bonds (105) may be electrically coupled (block 1302) to the inkjet slivers (102). The method may continue by electrically coupling (block 1303) a second end of the wire bonds (105) to a side connector (116) coupled to an edge of the at least one TIJ printhead (501).

In one example, overmolding (block 1301) the number of inkjet slivers (102) into the moldable substrate (101) includes overmolding a printed circuit board (PCB) (108) with the number of inkjet slivers (102) into the moldable substrate (101). The method may further include encapsulating the wire bonds (102) with an encapsulating material such as the encapsulant (111) to preclude exposure of the wire bonds (102) to the environment. A protective film (112) may be deposited on the encapsulating material (111) to maintain a low profile of the encapsulating material (111).

The specification and figures describe a thermal inkjet (TIJ) printhead. The TIJ printhead includes a number of inkjet slivers molded into a moldable substrate. The overmolded inkjet slivers form at least one TIJ die. The TIJ printhead also includes a number of wire bonds electrically coupling the inkjet slivers to a side connector. The side connector electrically couples the inkjet slivers to a controller of a printing device. This TIJ printhead may (1) eliminate the need to include chiclets or other fluid distribution manifolds or fluidic interposers in the printhead; (2) decrease manufacturing costs and increase cost efficiency through the use of epoxy mold compound (EMC) instead of expensive and difficult to manufacture silicon substrates; (3) reduce the silicon area within the printhead such that a 3 times or greater reduction in die cost is realized; (4) simplify the electrical interconnect to the printing device; and (5) greatly simplify the design of the printhead and the assembly process of the printhead, among other advantages.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead comprising:

a number of inkjet slivers overmolded into a moldable substrate, the overmolded inkjet slivers forming at least one printhead die, and wherein the moldable substrate is an epoxy molding compound (EMC) including an epoxide; and a number of wire bonds electrically coupling the overmolded inkjet slivers to a side connector, the side connector to electrically couple the overmolded inkjet slivers to a controller of a printing device.

2. The printhead of claim 1, wherein the side connector comprises a printed circuit board (PCB) side connector.

3. The printhead of claim 2, wherein the PCB side connector is overmolded into the moldable substrate.

4. The printhead of claim 1, wherein the side connector comprises a lead frame embedded into the moldable substrate, the lead frame comprising:

a number of electrical traces from the wire bonds; and a number of connection pads coupled to the electrical traces;

wherein the connection pads electrically couple the overmolded inkjet slivers to the controller of the printing device.

5. The printhead of claim 1, further comprising an encapsulating cover disposed on the wire bonds.

6. The printhead of claim 1, wherein the EMC is a self-crossing linking epoxy.

7. The printhead of claim 1, wherein the side connector is electrically coupled to the overmolded inkjet slivers at an edge of each of the overmolded inkjet slivers and the EMC is a polyepoxide.

8. A printhead die comprising:

a moldable substrate;

a number of inkjet slivers overmolded into the moldable substrate; and a number of electrical wire leads connecting the overmolded inkjet slivers to an edge connector coupled to the moldable substrate, the moldable substrate is an epoxy mold compound (EMC) including an epoxide.

9. The printhead die of claim 8, wherein the edge connector comprises:

a printed circuit board (PCB) embedded within the moldable substrate;

a first set of connectors coupled to the PCB to couple the PCB to the overmolded inkjet slivers via the wire leads; and a second set of connectors coupled to the PCB to couple the PCB to a printer controller.

10. The printhead die of claim 8, further comprising an encapsulating material disposed on the wire bonds.

11. The printhead die of claim 10, further comprising a protective film disposed on the encapsulating material to maintain a low profile of the encapsulating material.

12. A method of manufacturing a printhead comprising:

overmolding a number of inkjet slivers into a moldable substrate, the overmolded inkjet slivers forming at least one printhead die and the moldable substrate is an epoxy mold compound (EMC) including an epoxide;

electrically coupling a first end of a number of wire bonds to the overmolded inkjet slivers; and electrically coupling a second end of the wire bonds to a side connector coupled to an edge of the printhead.

13. The method of claim 12, wherein overmolding the number of inkjet slivers into the moldable substrate comprises overmolding a printed circuit board (PCB) with the number of inkjet slivers into the moldable substrate.

14. The method of claim 12, further comprising encapsulating the wire bonds with an encapsulating material to preclude exposure of the wire bonds to the environment.

15. The method of claim 14, further comprising depositing a protective film on the encapsulating material to maintain a low profile of the encapsulating material.

16. The method of claim 12, wherein overmolding the number of inkjet slivers into the moldable substrate includes:

overmolding a printed circuit board (PCB) with the number of inkjet slivers into the moldable substrate, the EMC including a self-cross-linking epoxy; and curing the EMC through catalytic homopolymerization.

17. The method of claim 12, further including encapsulating the wire bonds with an encapsulating material and depositing a protective film on the encapsulating material.

18. The method of claim 12, wherein overmolding the number of inkjet slivers into the moldable substrate includes:

overmolding a printed circuit board (PCB) with the number of inkjet slivers into the moldable substrate, the epoxide including a polyepoxide; and curing the EMC to form a thermosetting polymer.

19. The printhead of claim 1, wherein the number of overmolded inkjet slivers include a number of connection pads coupled to the number of wire bonds electrically coupling the overmolded inkjet slivers to the side connector.

20. The printhead of claim 1, further including a plurality of channels formed in a substrate of the plurality of inkjet slivers and overmolded into the EMC compound.

* * * * *